US006942333B2

(12) United States Patent
Ju et al.

(10) Patent No.: US 6,942,333 B2
(45) Date of Patent: Sep. 13, 2005

(54) INK CARTRIDGE EXCHANGING APPARATUS USED WITH AN IMAGE FORMING DEVICE

(75) Inventors: Young-bok Ju, Seongnam (KR); Gui-taek Lim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 156 days.

(21) Appl. No.: 10/682,864

(22) Filed: Oct. 14, 2003

(65) Prior Publication Data

US 2005/0052510 A1 Mar. 10, 2005

(30) Foreign Application Priority Data

Jan. 14, 2003 (KR) ..... 10-2003-0002534

(51) Int. Cl.[7] ..... B41J 29/13; B41J 2/175

(52) U.S. Cl. ..... 347/108; 347/86

(58) Field of Search ..... 347/49, 85–86, 347/108, 152; 346/105, 112, 134; 400/691, 693

(56) References Cited

U.S. PATENT DOCUMENTS 4,888,602 A * 12/1989 Watanabe et al. ..... 346/134
4,970,533 A * 11/1990 Saito et al. ..... 347/86
5,359,357 A * 10/1994 Takagi et al. ..... 347/49
5,631,681 A * 5/1997 Klaus et al. ..... 347/85
6,065,831 A * 5/2000 Kawaura et al. ..... 347/108
6,445,836 B1 * 9/2002 Fujiwara ..... 382/312
6,739,692 B2 * 5/2004 Unosawa ..... 347/22

* cited by examiner

*Primary Examiner*—Anh T. N. Vo
(74) *Attorney, Agent, or Firm*—Stanzione & Kim, LLP

(57) ABSTRACT

An ink cartridge exchanging apparatus used with an image forming device. The ink cartridge exchanging apparatus having an opening formed at a housing, and an ink cartridge ejecting unit containing at least one ink cartridge and movably disposed with respect to the carriage and the opening to be ejected outside the housing through the opening when exchanging or repairing the ink cartridge. The ink cartridge ejecting unit has a semi-carriage disposed in the carriage and movable between a mounting position and an ejecting position, the mounting position being a position where the semi-carriage is completely mounted in the carriage positioned in an ink cartridge exchanging position in the housing, and the ejecting position being a position where at least part of the semi-carriage is ejected outside of the housing through the opening from the carriage positioned in an ink cartridge exchanging position, to exchange or repair the ink cartridge, a movement guide to movably guide the semi-carriage smoothly with respect to the carriage, and a locking and/or releasing part locking the semi-carriage in the mounting position or releasing the semi-carriage from the mounting position. The ink cartridge exchanging apparatus can exchange the ink cartridge as well as minimize a working space required to exchange the ink cartridge, thereby reducing a size and a height of the image forming device.

27 Claims, 6 Drawing Sheets

INK CARTRIDGE EXCHANGING APPARATUS USED WITH AN IMAGE FORMING DEVICE

CROSS-REFERENCE TO RELATED APPLICATIONS

This application claims the benefit of Korean Application No. 2003-2534, filed on Jan. 14, 2003, in the Korean Intellectual Property Office, the disclosure of which is incorporated herein by reference.

BACKGROUND OF THE INVENTION

1. Field of the Invention

The present invention relates to an ink cartridge exchanging apparatus used with an image forming device, and more particularly, to an ink cartridge exchanging apparatus used with an image forming device, which can minimize a working space to exchange an ink cartridge, thereby reducing a size and a height of the image forming device.

2. Description of the Related Art

An image forming device using ink, for example, an ink jet printer 1, prints by ejecting ink onto a sheet of recording paper. The ink is ejected through a print head 2 while moving a carriage 3, having an ink cartridge 4 mounted thereon, at right and left directions along a carriage shaft 7 and a sliding bracket 9*a* of a support frame 9 by a carriage motor (not shown) connected with the carriage 3 through a carriage moving belt (not shown), as shown in FIG. 1. At a lower part of the ink cartridge 4 is disposed the print head 2. During such a printing operation, when the ink cartridge 4 completely uses up ink, it must be exchanged with a new one.

Generally, the exchange operation of the ink cartridge 4 is carried out by opening a cover door 5 disposed at an upper part of the ink jet printer, pushing an ink cartridge exchanging button (not shown) on a control panel (not shown) to apply an electric power to the carriage motor to move the carriage 3, having the ink cartridge 4 mounted thereon from a service position for maintenance, to an ink cartridge exchanging position by the carriage moving belt, releasing a fixing apparatus (not shown) to mount the ink cartridge 4 on the carriage 3, raising and removing the used ink cartridge 4 from the carriage 3, and then mounting a new ink cartridge 4 in the carriage 3.

At this point, the cover door 5 can be opened after the carriage 3 is moved from the service position to the ink cartridge exchanging position by pushing the ink cartridge exchanging button.

However, such a conventional ink jet printer 1 presents a problem that in order to exchange the used ink cartridge 4, the cover door 5 is opened upwardly toward an upper part of the printer and then the ink cartridge 4 is raised from the carriage 3, and a working space to exchange the ink cartridge 4 grows large, thereby resulting in increasing a size, particularly a height of the printer.

Also, since the conventional ink jet printer 1 needs a space to raise the used ink cartridge 4 from the carriage 3, there is a problem that it is difficult to meet various design demands, which are currently getting more and more increasing in the art, such as allowing the image forming device to have a flat facing, or to have the image forming device built in other devices.

SUMMARY OF THE INVENTION

It is an aspect of the present invention to solve the above and/or other problems by providing an improved ink cartridge exchanging apparatus used with an image forming device, which not only exchanges ink cartridges, but also minimizes a working space to exchange the ink cartridges, thereby reducing a size and a height of the image forming device.

It is another aspect of the present invention to provide an improved ink cartridge exchanging apparatus used with an image forming device, which can allow the image forming device to have a flat facing, or to be built in other devices.

Additional aspects and advantages of the invention will be set forth in part in the description which follows and, in part, will be obvious from the description, or may be learned by practice of the invention.

The foregoing and/or other aspects of the present invention are achieved by providing an ink cartridge exchanging apparatus used with an image forming device having a housing, a carriage disposed in the housing, and mounting at least one ink cartridge to store ink to be movable in the housing, the ink cartridge exchanging apparatus comprising an opening formed at the housing, and an ink cartridge ejecting unit containing the ink cartridge and movably disposed with respect to the carriage and the opening to be ejectable outside the housing through the opening to exchange or repair the ink cartridge.

In an embodiment of the present invention, the ink cartridge ejecting unit includes a semi-carriage disposed in the carriage and movable between a mounting position and an ejecting position, the mounting position being a position where the semi-carriage is completely mounted in the carriage, which is positioned in an ink cartridge exchanging position in the housing, and the ejecting position being a position where at least part of the semi-carriage is ejected outside of the housing through the opening of the carriage positioned in the ink cartridge exchanging position, to exchange or repair the ink cartridge, a movement guide to guide movement of the semi-carriage smoothly with respect to the carriage, and a locking and/or releasing part locking the semi-carriage at the mounting position or releasing the semi-carriage from the mounting position.

The semi-carriage has an ink storing part detachably receiving the ink cartridge, and an ink jetting part connected with the ink cartridge to jet ink. Preferably, the ink jetting part comprises a filter to filter ink supplied through the ink cartridge, an ink storing pipe to temporarily store ink passed through the filter, and a bubble-ink jet print head to jet ink flowing from the ink storing pipe.

The movement guide includes at least one rack disposed at an undersurface of the semi-carriage, and at least one pinion rotatably supported at the carriage to engage with the rack.

Alternatively, the movement guide may further include a subsidiary guide to guide the semi-carriage to be movable without swinging in upward and downward directions and right and left directions.

When the movement guide comprises two racks disposed at the undersurface of the semi-carriage and two pinions rotatably supported at the carriage to engage with the racks, the subsidiary guide comprises a guide plate disposed at one of the housing and the carriage to guide an upper surface of the semi-carriage to prevent the semi-carriage from swinging in the upward direction, sidewalls of the carriage disposed opposite to both side surfaces of the semi-carriage to prevent the semi-carriage from swinging in the right and left directions, and a bottom of the carriage supporting both edges of the undersurface of the semi-carriage adjacent to lower parts of the both side surfaces of the semi-carriage to prevent the semi-carriage from swinging in the downward direction.

Also, when the movement guide comprises one rack disposed at the undersurface of the semi-carriage and two pinions rotatably supported at the carriage and disposed longitudinally to engage with the rack, or two racks disposed at the undersurface of the semi-carriage and four pinions rotatably supported at the carriage, each pair of the four pinions being longitudinally disposed to engage with one of the two racks, the subsidiary guide comprises a guide plate disposed at one of the housing and the carriage to guide an upper surface of the semi-carriage to prevent the semi-carriage from swinging in the upward direction, and side-walls of the carriage disposed opposite to the both side surfaces of the semi-carriage to prevent the semi-carriage from swinging in the right and left directions.

The locking and/or releasing part is provided with a hook member disposed at the semi-carriage, a locking lever hinged at the carriage and movable between a locking position and a releasing position and having a corresponding hooking member to engage the hook member, the locking position being a position where the hooking member engages the hook member, and the releasing position being a position where the hooking member is released from the hook member, and an actuating member disposed at the housing to actuate the locking lever to move to the releasing position.

The locking and/or releasing part further includes a locking lever-restoring member to restore the locking lever to the locking position when a force pressed on the actuating member is removed after the locking lever is moved to the releasing position by the actuating member. In an aspect of the invention, the locking lever-restoring member comprises a first compression spring disposed between the locking lever and the carriage.

The actuating member is provided with a push button disposed at the housing and movable between a pushing position and a push-releasing position, the pushing position being a position where the push button actuates the locking lever to move to the releasing position, and the push-releasing position being a position where the push button does not actuate the locking lever, and a push button-restoring part to restore the push button to the push-releasing position. In an aspect of the invention, the push button comprises a rod movably inserted in a hole formed at the housing, a pusher disposed at one end of the rod, and a stopper disposed at the other end of the rod, and the push button-restoring part comprises a second compression spring disposed between the pusher of the push button and the housing.

The ink cartridge ejecting unit further includes an ejecting part to move the semi-carriage to the ejecting position when the actuating member moves the locking lever to the releasing position. In an aspect of the invention, the ejecting part comprises at least one third compression spring disposed at the carriage between the carriage and the semi-carriage to eject the semi-carriage outside of the housing through the opening when the locking lever is moved to the releasing position by the actuating member.

Also, the ink cartridge ejecting unit further comprises a connecting member to electrically connect a contact pad of the print head of the ink jetting part to a circuit part of the image forming device. The connecting member comprises a flexible printed cable having one end connected to the circuit part, and the other end fixed at the carriage and having a plurality of dimples in contact with contacts of the contact pad, and an elastic body disposed between the carriage and the other end of the flexible printed cable to increase a force of contact between the contacts of the contact pad and the dimples of the other end of the flexible printed cable.

Alternatively, the connecting member may comprise a flexible printed cable having one end connected to the circuit part, and the other end integrally connected with contacts of the contact pad.

In this embodiment, the housing is formed to have a flat quadrilateral facing.

The foregoing and/or other aspects of the present invention may also be achieved by providing an ink cartridge exchanging apparatus having a carriage movably mounted therein between a cartridge echanging position and a printing position, comprising an opening positioned therein, and an ink cartridge ejecting unit to hold ink cartridges therein and movably positioned within the carriage, the ink cartridge ejecting unit being ejectable through the opening to replace an ink cartridge.

In an aspect of this embodiment, the ink cartridge ejecting unit comprises a semi-carriage slidably positioned within the carriage between a mounting position and an ejecting position, the mounting position being a position where the semi-carriage is disposed within the carriage, and the ejecting position being a position where the semi-carriage is extended out of the carriage and through the opening of the ink cartridge exchanging apparatus, a movement guide to guide the semi-carriage with respect to the carriage, and a locking and releasing part to lock the semi-carriage at the mounting position and to release the semi-carriage from the mounting position.

The foregoing and/or other aspects of the present invention may also be achieved by providing an image forming device comprising a housing having a surface, a first opening formed in the surface, and through which a recording medium passes, a second opening formed on the surface, and an ink cartridge exchanger apparatus disposed inside the housing and having a carriage and an ink cartridge selectively protruding through the second opening.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
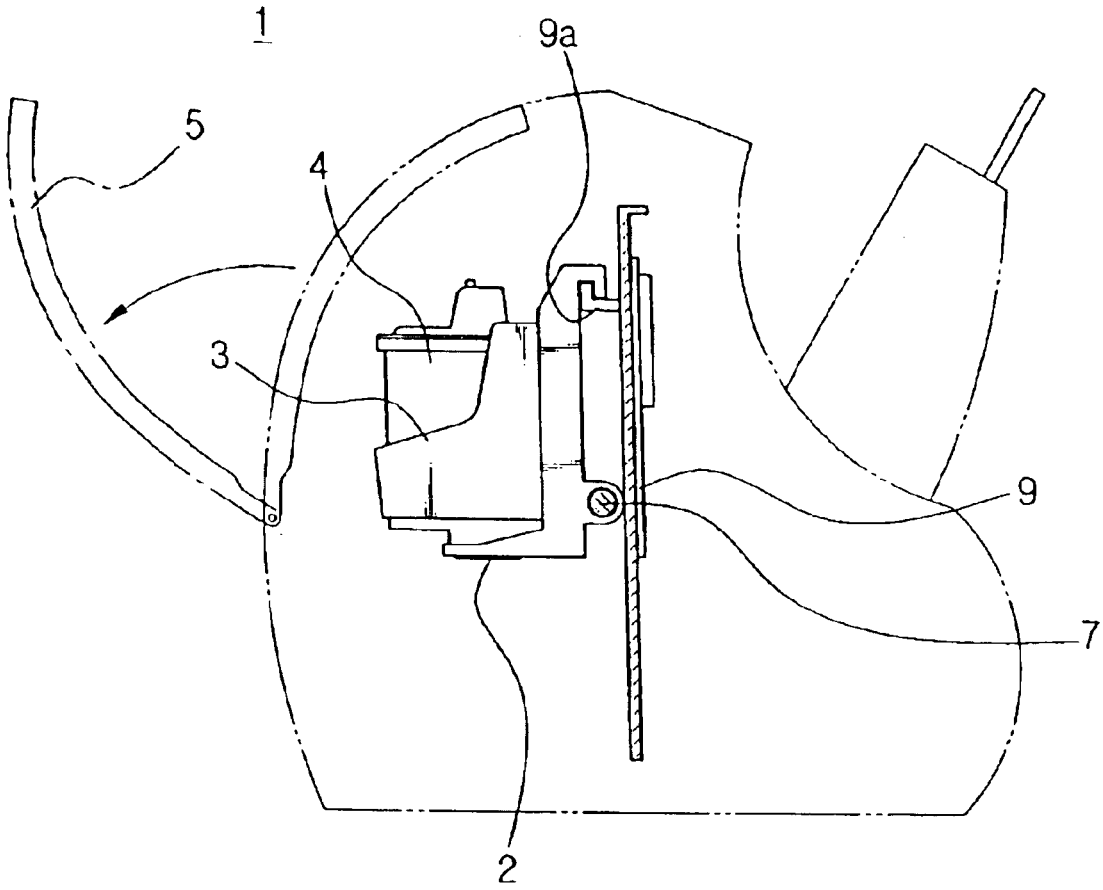
FIG. 1 (PRIOR ART)
FIG. 1 is a schematic cross-sectional view of a conventional ink jet printer.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3A:
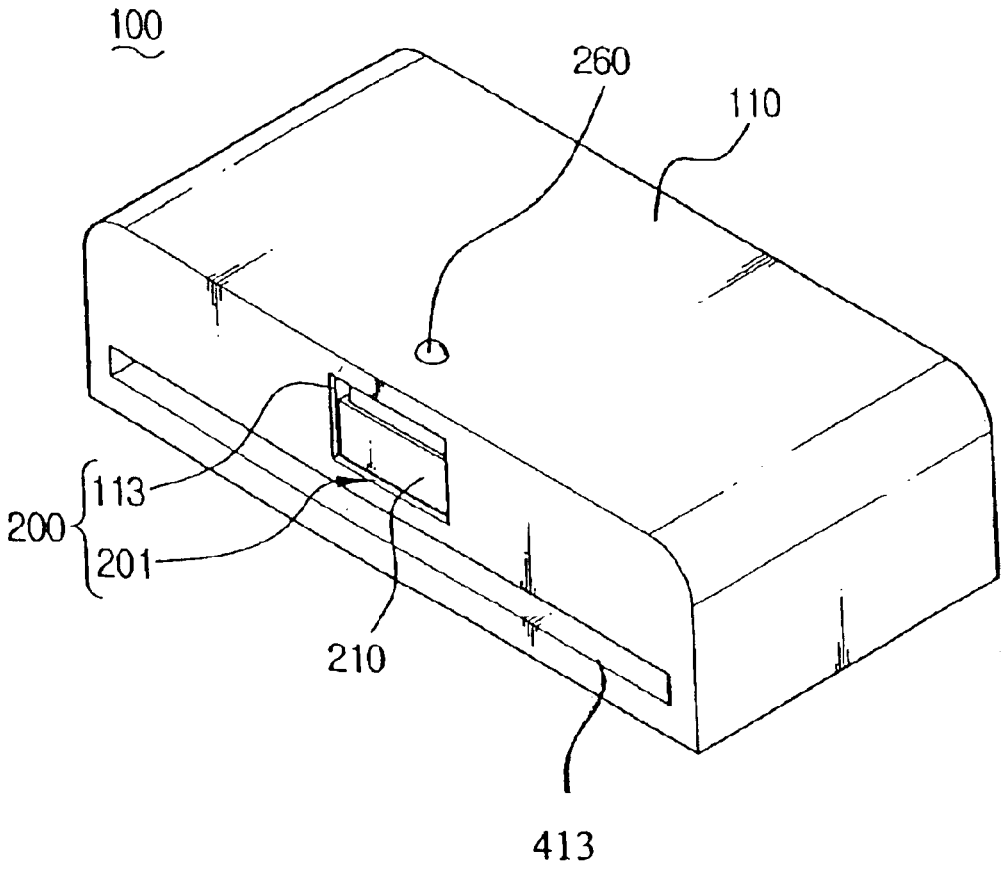
FIGS. 3A and 3B are a perspective view and a partial cross-sectional view, respectively, of an ink jet printer having the ink cartridge exchanging apparatus shown in FIG. 2.
Figure 4A:
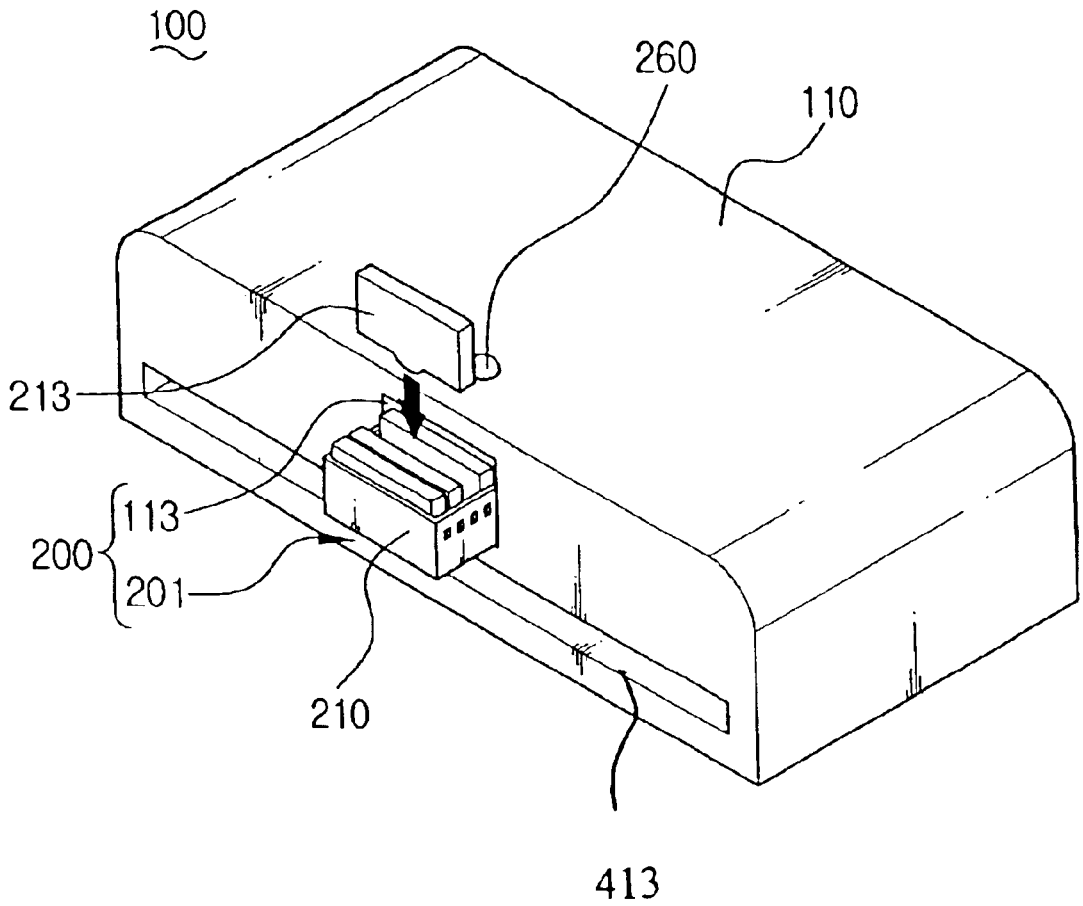
FIGS. 4A and 4B are a perspective view and a partial cross-sectional view, respectively, illustrating the operation of the ink jet printer having the ink cartridge exchanging apparatus shown in FIG. 2.

FIGS. 3A and 4A show an ink jet printer 100 in which an ink cartridge exchanging apparatus 200 of the present invention is applied.

The ink jet printer 100 comprises a housing 110 forming a facing of the printer, and a carriage 130 (FIGS. 3B and 4B) disposed in the housing 110. The ink jet printer 100 also includes a discharging and/or feeding opening 413 (FIGS. 3A and 4A) formed on a front face of the housing 110 to feed and/or discharge a recording medium into or from the ink jet printer 100. The carriage 130 movably mounts a semi-carriage 210 therein, so that the semi-cartridge 210 can move to a required position in the housing 110 of the printer 100. The semi-cartridge 210 has an ink storing part 211 (FIG. 2) and an ink jetting part 215 (FIG. 2), which is described below.

The housing 110 is formed to have a flat quadrilateral facing, so that the printer 100 can be built in other devices and a size of the printer 100 can be reduced.

Figure 2:
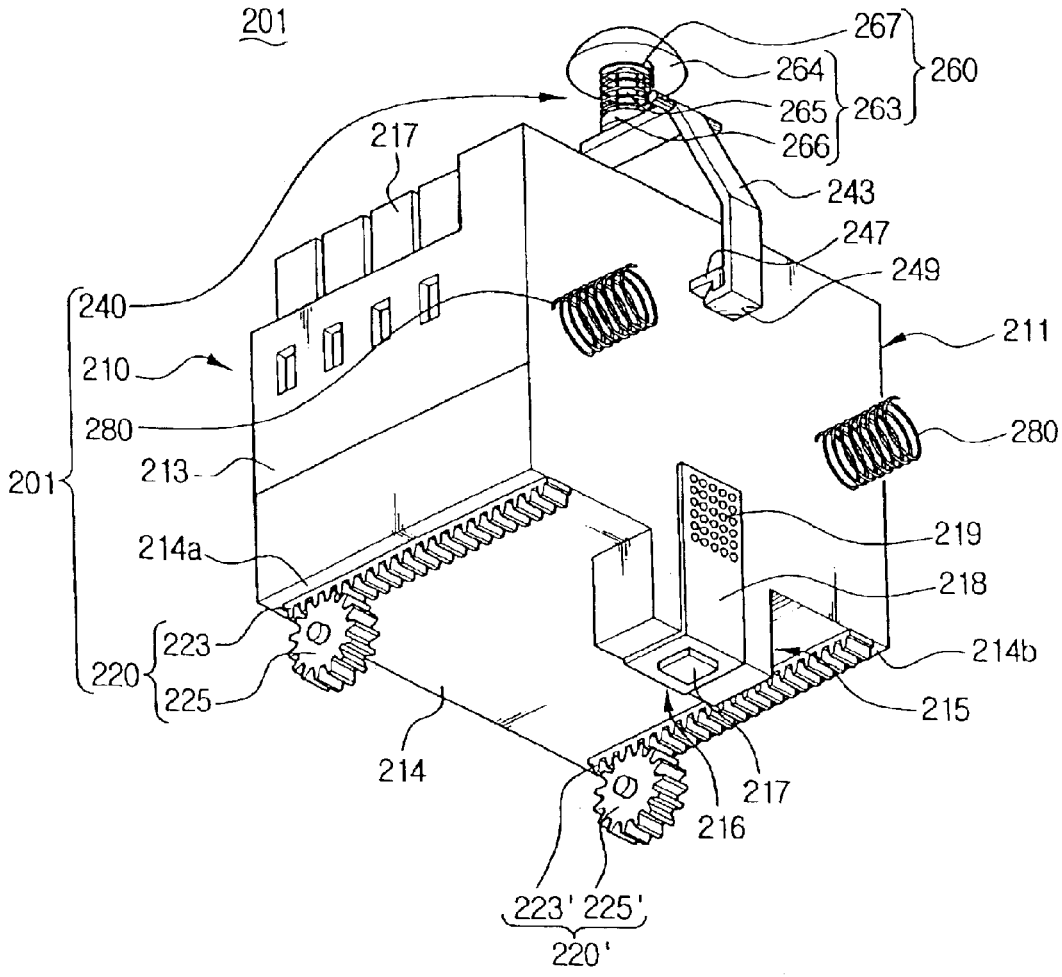
FIG. 2 is a partial perspective view of an ink cartridge exchanging apparatus used with an image forming device in accordance with an embodiment of the present invention.
Figure 3B:
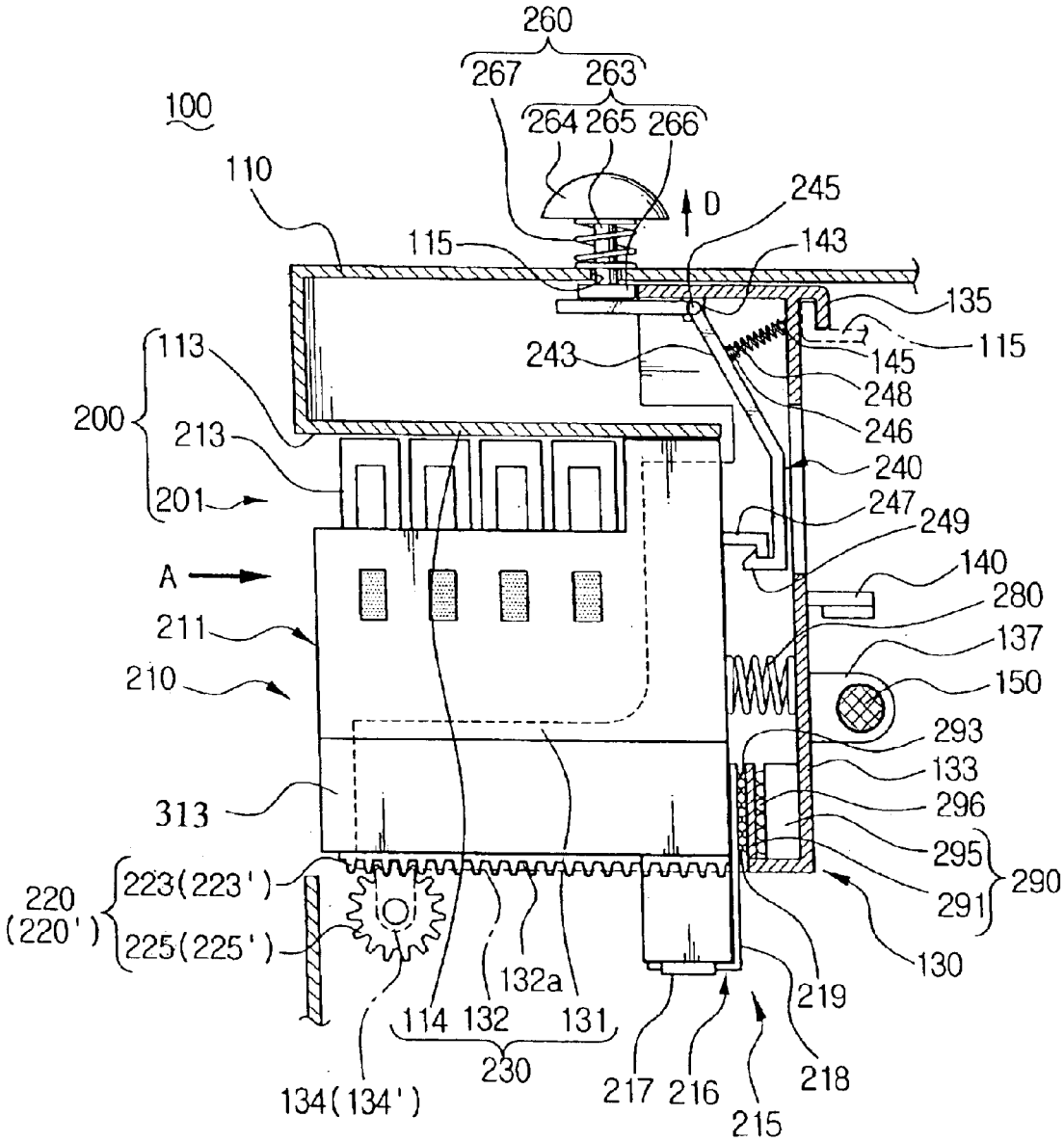
Figure 4B:
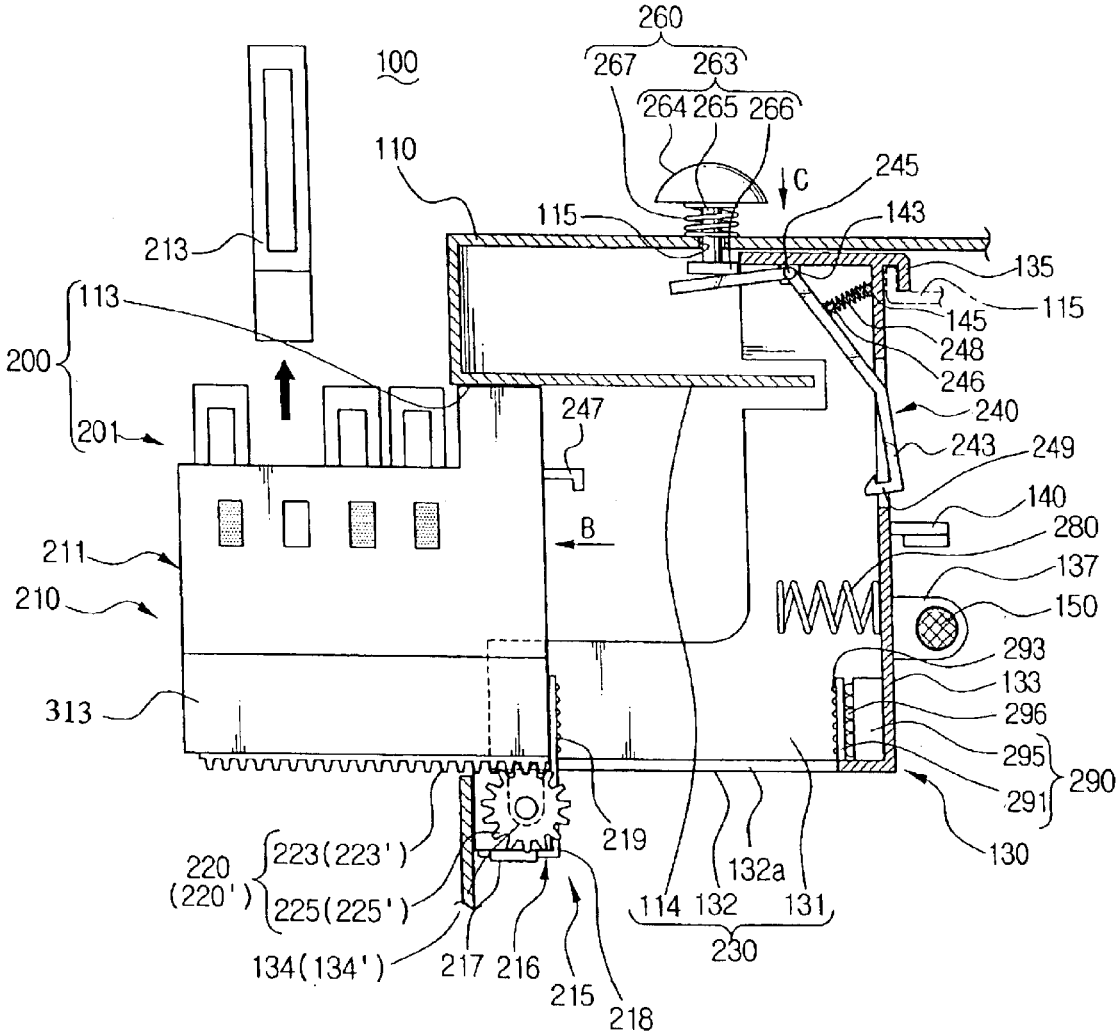

As shown in FIGS. 3B and 4B, the carriage 130 is provided with two sidewalls 131 (one shown) disposed opposite to both side surfaces 313 (one shown) of the semi-carriage 210, a bottom 132 supporting both edges 214*a* and 214*b* (FIG. 2) of a undersurface 214 of the semi-carriage 210 adjacent to lower parts of both side surfaces 213 of the semi-carriage 210 and having an opening 132*a* formed at a center part thereof to receive the ink jetting part 215 of the semi-carriage 210 and two racks 223 and 223' of movement guides 220 and 220', respectively, to be described later, and a rear wall 133 integrally connecting between the sidewalls 131 and the bottom 132 at a rear (a right side of the drawings) of the carriage 130.

The sidewalls 131 and the bottom 132 form a part of a subsidiary guide 230 which guides the semi-carriage 210 to move without swinging in upward and downward directions and right and left directions, as described below.

At a rear surface of the rear wall 133 are formed a sliding guide 135 to guide the carriage 130 to slide along a sliding bracket 116 of a support frame (not shown) in the housing 110, a power transmitting tooth part 140 connected to a carriage motor (not shown) through a carriage moving belt (not shown) to transmit a driving power of the carriage motor to the carriage 130, and a carriage shaft supporting bracket 137 to receive and support a carriage shaft 150 to ensure the carriage 130 to move at right and left directions along the carriage shaft 150.

Accordingly, when the carriage 130 is moved to a printing position, an ink cartridge exchanging position, and a service position, the carriage 130 is slid at the right and left directions along the carriage shaft 150 supported in the carriage shaft supporting bracket 137 and the sliding bracket 116 movably supporting the sliding guide 135 of the carriage 130, by the driving force of the carriage motor connected to the power transmitting tooth part 140 through the carriage moving belt.

As shown in FIGS. 2, 3A and 4A, the ink cartridge exchanging apparatus 200 of the present invention includes a cartridge opening 113 formed at the housing 110, and an ink cartridge ejecting unit 201 containing four ink cartridges 213 to store ink of magenta, cyan, yellow and black and movably disposed with respect to the carriage 130 and the cartridge opening 113 to be ejected outside of the housing 110 through the cartridge opening 113 when exchanging or repairing the ink cartridges 213.

The cartridge opening 113 is formed at a part of the housing 110 corresponding to an ink cartridge exchanging position (FIG. 3A) of the carriage 130. The ink cartridge exchanging position is a position where the carriage 130 arrives from the service position for maintenance of the ink jetting part 215 of the semi-carriage 210, after an ink cartridge exchanging button (not shown) on a control panel (not shown) is pushed.

Here, it should be noted that in FIG. 3A, although the ink cartridge exchanging position of the carriage 130, corresponding to which the cartridge opening 113 is formed, is illustrated as centrally located at the housing 110, it can be located at any other proper position of the housing 110.

The ink cartridge ejecting unit 201 is provided with the semi-carriage 210 disposed in the carriage 130 to be movable between a mounting position (FIGS. 3A and 3B) and an ejecting position (FIGS. 4A and 4B), the movement guide 220, 220' to guide the semi-carriage 210 to smoothly move with respect to the carriage 130, and a locking and/or releasing part 240 to lock the semi-carriage 210 in the mounting position or release the semi-carriage 210 from the mounting position. The mounting position is a position where the semi-carriage 210 is completely mounted in the carriage 130 which is positioned at the ink cartridge exchanging position in the housing 110, and the ejecting position is a position where at least a part of the semi-carriage 210 is ejected outside of the housing 110 through the cartridge opening 113 from the carriage 130 positioned at the ink cartridge exchanging position, thereby to exchange or repair the ink cartridges 213.

The semi-carriage 210 has an ink storing part 211 detachably receiving the ink cartridges 213, and the ink jetting part 215 connected with the ink cartridges 213 to jet ink.

As known in the art, the ink jetting part 215 is provided with a filter (not shown) to filter ink supplied through the ink cartridges 213, an ink storing pipe (not shown) such as a stand pipe to temporarily store ink passed through the filter, and a bubble-ink jet print head 216 to jet ink flowing from the ink storing pipe.

The print head 216 includes a substrate 217 having a nozzle plate with a plurality of heaters (not shown) and a plurality of nozzles (not shown) formed thereover, and a flexible printed circuit board 218 having a contact pad 219 and wirings (not shown) formed therein. The contact pad 219 and the wirings, which are connected with the substrate 217, electrically connect between the substrate 217 and a circuit part (not shown) of the printer 100 disposed separately from the carriage 130, through a connecting member 290 to be described later.

The movement guides 220 and 220' are provided with the two racks 223 and 223', respectively, disposed longitudinally (a horizontal direction of FIGS. 3B and 4B) at both sides of the undersurface 214 of the semi-carriage 210, and two pinions 225 and 225' rotatably supported at two pinion supporting brackets 134 and 134' to engage corresponding ones of the racks 223 and 223'. The two pinion supporting brackets 134 and 134' are disposed to extend in the downward direction from the bottom 132 of the carriage 130.

The movement guide 220, 220' further includes the subsidiary guide 230 to assist or guide the semi-carriage 210 to be movable without swinging in the upward and downward directions and in the right and left directions.

The subsidiary guide 230 comprises a guide plate 114 disposed at the cartridge opening 113 of the housing 110 to guide an upper surface of the semi-carriage 210, thereby preventing the semi-carriage 210 from swinging in the upward direction, the two sidewalls 131 of the carriage 130 disposed opposite to both side surfaces 313 of the ink storing part 211 of the semi-carriage 210 to prevent the semi-carriage 210 from swinging in the right and left directions, and the bottom 132 of the carriage 130 supporting both edges 214*a* and 214*b* of the undersurface 214 of the semi-carriage 210 adjacent to the lower parts of the both side surfaces 313 of the ink storing part 211 of the semi-carriage 210 to prevent the semi-carriage 210 from swinging in the downward direction.

Here, the guide plate 114 to guide the upper surface of the semi-carriage 210 can be formed at the carriage 130, instead of being formed at the housing 110.

Also, it should be noted that although the pinions of the movement guides 220 and 220' are illustrated as having a corresponding one of two pinions 225 and 225', each of which is engaged with one of two racks 223 and 223', they can alternatively have four pinions (not shown), each pair of which are engaged with one of the two racks 223 and 223'. The four pinions are rotatably supported respectively at four pinion supporting brackets (not shown), each pair of which are extended in the downward direction from the bottom 132 of the carriage 130 to be longitudinally disposed along each of the racks 223 and 223'.

In this case, since during the movement the semi-carriage 210 is not swung in the downward direction by the four longitudinally disposed pinions, it is not necessary for the carriage 130 to have the bottom 132 to guide downward movement of the semi-carriage 210. At this point, the guide plate 114 of the housing 110 together with the sidewalls 131 function as the subsidiary guide 230 to guide upward movement of the semi-carriage 210 and to guide right and left movements of the semi-carriage 210, respectively and the four pinion supporting brackets are formed at the sidewalls 131.

Also, alternatively, the movement guide 220, 220' can comprise one rack (not shown) disposed at a center of the undersurface 214 of the semi-carriage 210, and two pinions (not shown), each of which is rotatably supported respectively at a corresponding one of two pinion supporting brackets (not shown) to engage with the one rack. The two pinion supporting brackets are extended in the downward direction from the bottom 132 of the carriage 130 to be longitudinally disposed along the one rack.

In this case, as described above, since during the movement of the semi-carriage 210 it is not swung in the downward direction by the two longitudinally disposed pinions, it is not necessary for the carriage 130 to have the bottom 132 to guide downward movement of semi-carriage 210. At this point, the guide plate 114 of the housing 110 together with the sidewalls 131 function as the subsidiary guide 230 to guide upward movement of the semi-carriage 210 and to guide right and left movements of the semi-carriage 210, respectively, and the two pinion supporting brackets are formed at the sidewalls 131.

The locking and/or releasing part 240 is provided with a hook member 247 disposed at an upper part of a rear surface of the semi-carriage 210, a locking lever 243 having a corresponding hooking member 249 formed at one end thereof to engage the hook member 247, and a hinge axle 245 disposed on a hinge bracket 143 formed at an upper part of the rear wall 133 of the carriage 130 to be movable between a locking position (FIG. 3B) and a releasing position (FIG. 4B), and an actuating member 260 disposed at the housing 110 to provide a pushing force on the other end of the locking lever 243, thereby actuating the locking lever 243 to move to the releasing position. The locking position is a position where the hooking member 249 engages with the hook member 247, and the releasing position is a position where the hooking member 249 is released from the hook member 247.

The locking and/or releasing part 240 further includes a locking lever-restoring member 248 disposed between the locking lever 243 and the rear wall 133 of the carriage 130 to restore the locking lever 243 to the locking position when a force pressed on the actuating member 260 is removed after the locking lever 243 is moved to the releasing position by the actuating member 260. In an aspect of the invention, the locking lever-restoring member 248 comprises a first compression spring having one end fixed and supported at a first fixing part 246, formed on the locking lever 243, and the other end fixed and supported at a second fixing part 145, formed on an upper part of the rear wall 133.

The actuating member 260 is provided with a push button 263 disposed at the housing 110 to be movable between a pushing position (FIG. 4B) and a push-releasing position (FIG. 3B), and a push button-restoring part 267 to restore the push button 263 to the push-releasing position. The pushing position is a position where the push button 263 actuates the locking lever 243 to move the locking lever to the releasing position, and the push-releasing position is a position where the push button 263 does not actuate the locking lever 243.

In an aspect of the present invention, the push button 263 comprises a rod 265 movably inserted in a hole 115 formed at the housing 110, a pusher 264 disposed at one end of the rod 265, and a stopper 266 disposed at the other end of the rod 265, and the push button-restoring part 267 comprises a second compression spring disposed between the pusher 264 of the push button 263 and the housing 110.

The ink cartridge ejecting unit 201 of the present invention further including an ejecting part 280 to move the semi-carriage 210 to the ejecting position when the push button 263 of the actuating member 260 is pushed to the pushing position to move the locking lever 243 to the releasing position. In an aspect of the present invention, the ejecting part 280 comprises two third compression springs disposed at a spaced-apart relation with each other on the front surface of the rear wall 133 of the carriage 130 between the carriage 130 and the semi-carriage 210. It is to be noted that the number of third compression springs is not limited to two, but rather can vary in number. The ejecting part 280 functions to eject the semi-carriage 210 outside the housing 110 through the cartridge opening 113 when the locking lever 243 is moved to the releasing position by the push button 263 of the actuating member 260.

Also, the ink cartridge ejecting unit 201 further includes a connecting member 290 to electrically connect the contact pad 219 of the print head 216 of the ink jetting part 215 to the circuit part of the printer disposed separately from the carriage 130 in the housing 110.

The connecting member 290 comprises a flexible printed cable 291 having one end connected to the circuit part and the other end fixed at the rear wall 133 of the carriage 130 and having a plurality of dimples 293 to be in contact with contacts of the contact pad 219, and an elastic body 295 disposed on the front surface of the rear wall 133 between the rear wall 133 of the carriage 130 and the other end of the flexible printed cable 291 to increase a force of contact between the contacts of the contact pad 219 and the dimples 293 of the other end of the flexible printed cable 291.

The elastic body 295 has a plurality of projections 296 to press the dimples 293 of the other end of the flexible printed cable 291 against the contacts of the contact pad 219.

Alternatively, the connecting member 290 may comprise a flexible printed cable (not shown) having one end connected to the circuit part and the other end integrally connected with contacts of the contact pad 219 of the print head 216.

The operation of the ink cartridge exchanging apparatus 200 of the ink jet printer 100 of the present invention constructed as above is explained below in detail with reference to FIGS. 2 through 4B.

To repair or exchange used ink cartridges 213, when the ink exchanging button of the control panel is pushed, the carriage 130 moves from the service position for maintenance of the ink jetting position part 215 of the semi-cartridge 210 to the ink cartridge exchanging position shown in FIG. 3A along the carriage shaft 150, movably supported in the carriage shaft supporting bracket 137, and the sliding bracket 116, movably supporting the sliding guide 135 of the carriage 130, by the driving power of the carriage motor connected to the power transmitting tooth part 140 through the carriage moving belt.

After the carriage 130 is moved to the ink cartridge exchanging position, as shown in FIG. 4B, when a user pushes the pusher 264 of the push button 263 in a direction of arrow C (FIG. 4B) against an elastic force of the second compression spring of the push button-restoring part 267 to move it to the pushing position, the stopper 266 of the push button 263 presses another end of the locking lever 243, so that the locking lever 243 rotates in a counterclockwise direction about an axis of the hinge axle 245 against an elastic force of the first compression spring of the locking lever-restoring member 248. As a result, the corresponding hooking member 249, disposed at one end of the locking lever 243, escapes from the hook member 247, and the locking lever 243 is thereby moved to the releasing position.

As the locking lever 243 is moved to the releasing position, the third compression spring forming the ejecting part 280 pushes the rear surface of the semi-carriage 210 in a direction of arrow B of FIG. 4B. Accordingly, by the racks 223 and 223' moving along the pinions 225 and 225', the semi-carriage 210 is ejected outside of the housing 110 through the cartridge opening 113 until the ink jetting part 215 comes into contact with the housing 110, i.e., the semi-carriage is moved to the ejecting position where the ink cartridges 213 are exposed externally. At this point, the semi-carriage 210 is guided along the guide plate 114 of the housing 110, the sidewalls 131 and the bottom 132 of the carriage 131, so that the semi-carriage 210 moves without swinging in the upward and downward directions and the right and left directions.

Also, at this point, after the locking lever 243 is moved to the releasing position, when a pushing force pressed on the push button 263 is removed, the locking lever 243 rotates in a clockwise direction to be once again restored to the locking position by the elastic force of the first compression spring of the locking lever-restoring member 248, and the push button 263 is raised up and restored to the push-releasing position by the elastic force of the second compression spring of the push button-restoring part 267 and the first compression spring of the locking lever-restoring member 248.

At this state, the used ink cartridges 213 are either exchanged with a new one or repaired.

After that, to move the semi-cartridge 210 back to the mounting position, as shown in FIG. 3B, when a user pushes the front surface of the semi-cartridge 210 in a direction of arrow A of the drawing, the semi-cartridge 210 moves into the housing 110 against an elastic force of the third compression spring(s) by the racks 223 and 223' moving along the pinions 225 and 225', until the hook member 247 is engaged with the hooking member 249 of the locking lever 243.

As the hook member 247 is engaged with the hooking member 249 of the locking lever 243 such that the semi-cartridge 210 is located at the mounting position, the contacts of the contact pad 219 of the ink jetting part 215 come into contact with the dimples 293 of the flexible printed cable 291. At this point, the dimples 293 of the flexible printed cable 291 are pressed by the projections 296 of the elastic body 295, so that the dimples 293 can be stably connected with the contacts of the contact pad 219.

Thereafter, when a print command is issued, or a head cleaning button (not shown) of the control panel is pushed, the carriage 130 moves to the service position or the print position along the carriage shaft 150 and the sliding bracket 116, by the driving power of the carriage motor connected to the power transmitting tooth part 140 through the carriage moving belt.

As apparent from the foregoing description, it can be appreciated that the ink cartridge exchanging apparatus of the ink jet printer of the present invention provides an effect that can not only simply exchange the ink cartridges, but also minimizes a working space to exchange the ink cartridge, thereby reducing a size and a height of the image forming device.

Also, the ink cartridge exchanging apparatus of the present invention provides an effect that can allow the ink jet printer to have a flat facing, or to be built in other devices.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An ink cartridge exchanging apparatus having a carriage movably mounted therein between a cartridge exchanging position and a printing position, comprising:

an opening positioned therein; and an ink cartridge ejecting unit to hold ink cartridges therein and movably positioned within the carriage, the ink cartridge ejecting unit being ejected through the opening to replace an ink cartridge.

2. The ink cartridge exchanging apparatus according to claim 1, wherein the ink cartridge ejecting unit comprises:

a semi-carriage slidably positioned within the carriage between a mounting position and an ejecting position, the mounting position being a position where the semi-carriage is disposed within the carriage, and the ejecting position being a position where the semi-carriage is extended out of the carriage and through the opening of the ink cartridge exchanging apparatus;

a movement guide to guide the semi-carriage with respect to the carriage; and a locking and releasing part to lock the semi-carriage at the mounting position and to release the semi-carriage from the mounting position.

3. The ink cartridge exchanging apparatus according to claim 2, wherein the semi-carriage comprises:

an ink storing part to receive and store an one or more ink cartridges; and an ink jetting part to jet ink from the one or more ink cartridges.

4. The ink cartridge exchanging apparatus according to claim 2, wherein the movement guide comprises a rack and pinion unit in contact with the semi-carriage to smoothly move the semi-carriage into and out of the carriage when the carriage is positioned at the cartridge exchanging position.

5. The ink cartridge exchanging apparatus according to claim 4, wherein the movement guide is positioned under the semi-carriage.

6. The ink cartridge exchanging apparatus according to claim 4, wherein the movement guide further comprises a subsidiary guide to guide the semi-carriage linearly into and out of the carriage without swinging from side to side or up and down.

7. The ink cartridge exchanging apparatus according to claim 6, wherein the movement guide further comprises:

at least one rack, and two pinions per each at least one rack to engage the at least one rack, respectively; and wherein the subsidiary guide comprises:

a guide plate disposed at one of the housing and the carriage to guide an upper surface of the semi-carriage to prevent the semi-carriage from swinging in the upward direction, and sidewalls of the carriage disposed opposite to both side surfaces of the semi-carriage to prevent the semi-carriage from swinging in the right and left direction.

8. The apparatus according to claim 6, wherein the movement guide comprises:

two racks disposed at the undersurface of the semi-carriage; and two pinions rotatably supported at the carriage to engage with the racks; and wherein the subsidiary guide comprises:

a guide plate disposed at one of the housing and the carriage to guide an upper surface of the semi-carriage to prevent the semi-carriage from swinging in the upward direction;

sidewalls of the carriage disposed opposite to both side surfaces of the semi-carriage to prevent the semi-carriage from swinging in the right and left direction; and a bottom of the carriage supporting both edges of the undersurface of the semi-carriage adjacent to lower parts of the both side surfaces of the semi-carriage to prevent the semi-carriage from swinging downward.

9. The apparatus according to claim 2, wherein the locking and/or releasing part comprises:

a hook member disposed at the semi-carriage;

a locking lever hinged at the carriage and movable between a locking position and a releasing position and having a hooking member to engage the hook member, the locking position being a position where the hooking member engages with the hook member, and the releasing position being a position where the hooking member is released from the hook member; and an actuating member disposed at the housing to actuate the locking lever to move to the releasing position.

10. The apparatus according to claim 9, wherein the locking and/or releasing part further comprises a locking lever-restoring member to restore the locking lever to the locking position when a force pressed on the actuating member is removed after the locking lever is moved to the releasing position by the actuating member.

11. The apparatus according to claim 10, wherein the locking lever-restoring member comprises a first compression spring disposed between the locking lever and the carriage.

12. The apparatus according to claim 9, wherein the actuating member comprises:

a push button disposed at the housing and movable between a pushing position and a push-releasing position, the pushing position being a position where the push button actuates the locking lever to move to the releasing position, and the push-releasing position being a position where the push button does not actuate the locking lever; and a push button-restoring part restoring the push button to the push-releasing position.

13. The apparatus according to claim 12, wherein the push button comprises:

a rod movably inserted in a hole formed at the housing;

a pusher disposed at one end of the rod; and a stopper disposed at the other end of the rod.

14. The apparatus according to claim 12, wherein the push button-restoring part comprises a second compression spring disposed between the push button and the housing.

15. The apparatus according to claim 9, wherein the ink cartridge ejecting unit further comprises an ejecting part to move the semi-carriage to the ejecting position when the actuating member moves the locking lever to the releasing position.

16. The apparatus according to claim 15, wherein the ejecting part comprises at least one third compression spring disposed at the carriage between the carriage and the semi-carriage to eject the semi-carriage outside of the housing through the opening when the locking lever is moved to the releasing position by the actuating member.

17. The apparatus according to claim 2, wherein the semi-carriage comprises:

an ink storing part detachably receiving the ink cartridge; and an ink jetting part connected With the ink cartridge to jet ink.

18. The apparatus according to claim 17, wherein the ink jetting part comprises:

a filter to filter ink supplied through the ink cartridge;

an ink storing pipe to temporarily store ink passed through the filter; and a bubble-ink jet print head to jet ink flowing from the ink storing pipe.

19. The apparatus according to claim 18, wherein the ink cartridge ejecting unit further comprises a connecting member to electrically connect a contact pad of the print head of the ink jetting part to a circuit part of the image forming device.

20. The apparatus according to claim 19, wherein the connecting member comprises:

a flexible printed cable having one end connected to the circuit part, and the other end fixed at the carriage and having a plurality of dimples to be in contact with contacts of the contact pad; and an elastic body disposed between the carriage and the other end of the flexible printed cable to increase a force of contact between the contacts of the contact pad and the dimples of the other end of the flexible printed cable.

21. The apparatus according to claim 19, wherein the connecting member comprises a flexible printed cable having one end connected to the circuit part, and the other end integrally connected with contacts of the contact pad.

22. An image forming device comprising:

a housing having a surface;

a first opening formed in the surface, and through which a recording medium passes;

a second opening formed on the surface; and an ink cartridge exchanger apparatus disposed inside the housing and having a carriage and an ink cartridge selectively protruding through the second opening.

23. The image forming device according to claim 22, wherein the surface is a flat surface.

24. The image forming device according to claim 23, wherein the surface is not movably attached to the housing.

25. The image forming device according to claim 22, wherein the housing comprises a front wall, a rear wall, a top wall, sidewalls, and the surface is formed on the front wall.

26. The image forming device according to claim 22, wherein the recording medium and the cartridge move through the first and second openings, respectively, in a same direction.

27. The image forming device according to claim 25, wherein the front wall is not rotatable with respect to the housing.

* * * * *